US005138875A

United States Patent [19]

Booer

[11] Patent Number: 5,138,875

[45] Date of Patent: Aug. 18, 1992

[54] METHOD OF MONITORING THE DRILLING OF A BOREHOLE

[75] Inventor: Anthony Booer, Huntingdon, United Kingdom

[73] Assignee: Schlumberger Technology Corporation, Houston, Tex.

[21] Appl. No.: 547,737

[22] Filed: Jul. 2, 1990

[30] Foreign Application Priority Data

Jul. 19, 1989 [GB] United Kingdom ..... 8916459

[51] Int. Cl.[5] ..... E21B 47/00

[52] U.S. Cl. ..... 73/151; 73/579; 73/659; 73/660; 175/39; 175/40

[58] Field of Search ..... 73/151, 570, 579, 659, 73/660; 175/39, 40, 50

[56] References Cited

U.S. PATENT DOCUMENTS

| | | | |
|---|---|---|---|
| Re. 28,436 | 6/1975 | Vitter et al. | 175/39 |
| 3,520,375 | 7/1970 | Raynal et al. | 175/50 |
| 3,626,482 | 12/1971 | Quichaud et al. | 73/151 |
| 3,714,822 | 2/1973 | Lutz | 73/151 |
| 4,150,568 | 4/1979 | Berger et al. | 73/151 |
| 4,773,263 | 9/1988 | Lesage et al. | 73/151 |
| 4,928,521 | 5/1990 | Jardine | 73/151 |

*Primary Examiner*—Hezron E. Williams
*Assistant Examiner*—Michael Brock
*Attorney, Agent, or Firm*—Henri Dupont; Martin Hyden; John J. Ryberg

[57] ABSTRACT

The invention relates to a method of monitoring the drilling of a borehole through an earth formation with a rotating drill bit fixed at the lower end of a drillstring. At least one physical quantity associated with the vibrations resulting from the interaction of the rotating drill bit with the earth formation is detected and an oscillatory signal is generated in response thereto. Filter coefficients $a_k$ of an auto-regressive filter model are determined by fitting the filter output signal with the oscillatory signal. The reflection coefficients of the vibrations propagating along the drill string and being reflected by a mis-match of impedance of two successive elements of the system earth formation/drillstring are derived from the filter coefficients. Finally, the hardness of the formation being drilled, the contact of the drillstring with the borehole and the vibration level of the vibration along the drillstring are determined from the reflection coefficients.

8 Claims, 5 Drawing Sheets

14
22
24
50
10
46
26
48
28
52
42
44
56
54
30
38
36
34
40
12
16
32
20
58
18

METHOD OF MONITORING THE DRILLING OF A BOREHOLE

The invention relates to monitoring the drilling operations of a borehole through an earth formation with a rotating drill bit fixed at the lower end of a drillstring. The vibrations produced by the drill bit when drilling are detected and analysed so as to determine at least one physical characteristic related to the drilling of the borehole, such as an indication of the lithology being drilled, the contacts between the drillstring and the borehole wall and the level of vibrations produced by the drill bit.

When drilling a borehole in the earth either for the search of hydrocarbons or for geothermal purposes, a drillstring comprising drill pipes, drill collars and a drill bit, is rotated from the surface to drill the wellbore. Roller cone bits are widely used. They have cone shaped steel devices called cones that are free to turn as the bit rotates. Most roller cone bits have three cones although some have two and some have four. Each cone has cutting elements which are circumferential rows of teeth extending from each cone. The cutting elements are either steel teeth which are machined as part of the cone or sintered tungsten carbide teeth which are pressed into holes drilled in the cone surfaces. The geometry of a bit, and more particularly of its cones, is such that when the bit is rotated, the cones rotate, the teeth having a combined rolling and gouging action which drills the formation in contact with the drill bit.

As teeth bite against the rock one after another, they generate noise or vibration with frequency components determined by the rates at which teeth successively encounter the rock. Various methods have already been proposed to determine the drilling conditions by recording and analysing the vibrations generated by the drill bit.

It is proposed in U.S. Pat. No. 4,773,263 to obtain the frequency spectrum of the vibrational signal, by processing it through a Fourier transform, so as to determine the working rate of the bit. The frequency spectrum has been found to include various significant peaks which pertain to different tooth rows of the bit. Peak frequencies tend to increase as teeth wear, because the mean rate of rotation of a cutter (normalised relative to bit speed) tends to increase. Therefore the shift of peak frequencies gives useful information on wear and hence whether it is yet time to pull out the drillstring. Furthermore, abrupt changes in the form of the frequency spectrum are indicative of abrupt occurrences at the bit such as loss of a tooth. This may lead to the appearance of a new peak as an unbroken tooth is forced to take over the work previously done by the broken tooth. Loss of frequency peaks indicate that a cone has struck or is clogged by a ductile rock.

On the other hand, it has already been appreciated that lithological information could be obtained by analysing the vibrations produced by the drill bit. At very simple level, the harder the rock, the louder the noise. It is proposed in U.S. Pat. No. 3,520,375 to obtain an indication on the mechanical characteristics of a rock while it is being drilled. Vibrations in the drilling assembly are detected at the upper part of the assembly and transformed into electrical signals. These signals are sampled and compared with a reference signal, so as to give an indication of the mechanical properties of the rock, which is connected with its hardness. More particularly, the impedance of the rock is deduced from the measurement.

It is proposed in U.S. Pat. No. 3,626,482 to measure the amplitude of the vibrations in a frequency band or window centred on a multiple of the speed of rotation of the bit. This multiple is intended to take account of the number of teeth which are carried by the tool. Logs, called SNAP logs, based on this technology have been but are no longer used by drilling companies. The above references propose detecting the vibrational energy at the top of the string or in the vicinity of the bit, in which case amplitude is transmitted up the borehole by the well known technique of mud pulsing.

In the above mentioned techniques, the vibration data obtained as a function of time are converted in the frequency domain so as to obtain the frequency spectrum. This is achieved by the well known operation of Fourier transform. However, in cases where the time span during which the data are acquired is short, the resolution of the frequency spectrum obtained in this way is limited. In addition, the methods of the prior art require information about the geometry of the drillstring and restricted assumptions are made about the interaction between the drillstring and the well bore.

In the present invention, the vibration data acquired in the time domain are not necessarily converted into the frequency domain. For short time span data, a signal processing technique may be used to avoid the limitation of the resolution of the frequency spectra due to the Fourier transform. In addition no geometrical description of the drillstring is required and there is no restriction that contact between the drillstring and the well bore is known.

In a preferred embodiment of the present invention, the method of monitoring the drilling of a bore hole in an earth formation with a rotating drill bit fixed at the lower end of the drillstring comprises the steps of:

- detecting with at least one transducer one physical quantity associated with the vibrations resulting from the interaction of the rotating drill bit with the earth formation and generating an oscillatory signal in response thereto;
- determining the filter coefficients $a_k$ of a filter model by fitting the filter output signal with the oscillatory signal;
- from said filter coefficients deriving the reflection coefficients of the vibrations propagating along the drillstring and being reflected by a mismatch of impedance of two successive elements of the system earth formation/drillstring; and
- determining from said reflection coefficients at least one physical characteristic related to the drilling of the borehole.

The filter model is advantageously an auto-regressive filter which can be driven by an input signal whose frequency amplitude is substantially constant over a large frequency band. In cases where the vibrations vary significantly in amplitude over the frequency band, the amplitudes of the data may be made substantially uniform by a variety of methods.

According to the preferred embodiment, the filter coefficients of the autoregressive filter are converted into the coefficients of a lattice filter which represent said reflection coefficients.

The reflection coefficients are used to characterise the lithology of the formation, the interactions between the borehole wall and the drillstring and the level of vibrations occurring in the drillstring at particular points in the drillstring.

The invention will now be described in more detail, by way of an example, and with reference to the accompanying drawings, in which.

Figure 1:
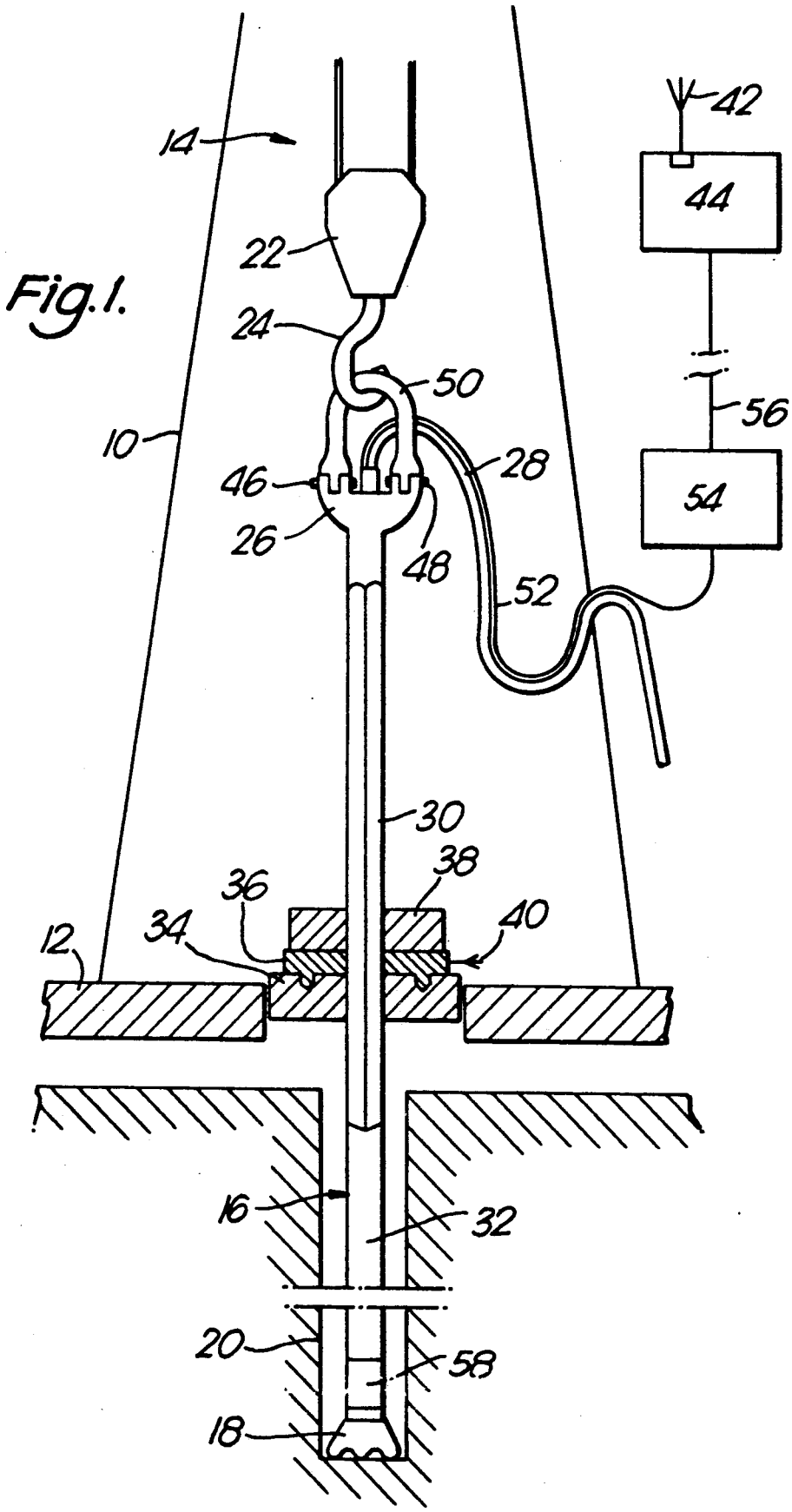
FIG. 1 shows schematically the equipment used at the surface on a drilling rig to detect and interpret the vibrations generated by the drill bit downhole.

FIG. 1 is a schematic view of the equipment which can be used to measure vibrations on an oil drilling rig. The derrick shown in FIG. 1 comprising a mast 10 standing on the rig floor 12 and equipped with a lifting system 14, on which is suspended a drillstring 16 carrying at its lower end a drill bit 18 for drilling a well 20. The lifting system 14 comprised a crown block (not represented) fixed to the top of the mast 10 and a vertically mobile travelling block 22 to which is attached a hook 24. The drillstring 16 can be suspended on hook 24 via an injection head 26 connected by a flexible hose 28 to a mud pump which makes it possible to circulate into the well 20 a drilling mud from a mud pit. The drillstring 16 comprises a driving rod 30, or kelly, and is formed from pipes 32 joined end to end by screwing. The drillstring is rotated by the rotary table 34. The vibration signals generated by the drill bit 18 are preferably detected at the surface, but could also be detected downhole although the algorithms to use to practice the invention would be more complicated. When the detection is made at the surface, the equipment comprises a torque meter 36 fixed between the rotary table 34 and the kelly bushing 38. Torque meter 36 measures the torsional force, or torque (TOR), applied to the drillstring 16. It comprises an antenna 40 to transmit the torque signal to a receiving antenna 42 of a data acquisition and processing system 44. The torque meter 36 is preferably of the type described in U.S. Pat. No. 4,471,663. The vertical force applied on the drillstring, or weight on bit (WOB), is measured by two load pins 46 and 48 fixing together the injection head 26 to the hook 50, itself hung on the hook 24. The load pins comprise strain gauges which are connected by the electrical cable 52 to a junction box 54 which is itself connected to the data acquisition and processing unit 44 via a cable 56. These load pins and the torque meter are commercially available. Accelerometers could also be used in addition to the torque meter and load pins, in order to measure accelerations on the torque meter and injection head.

When the vibration signals are detected downhole, for example in a measurement while drilling (MWD) operation, a sub 58 is located downhole on top of the drill bit 18 in the MWD tool. The sub 58 comprises sensors to measure the torque and weight on bit applied to the drill bit 18. Such a sub is, for example, described in U.S. Pat. 4,359,898 and is used commercially by the company Anadrill of Sugar Land (Tex.).

Figure 2A:
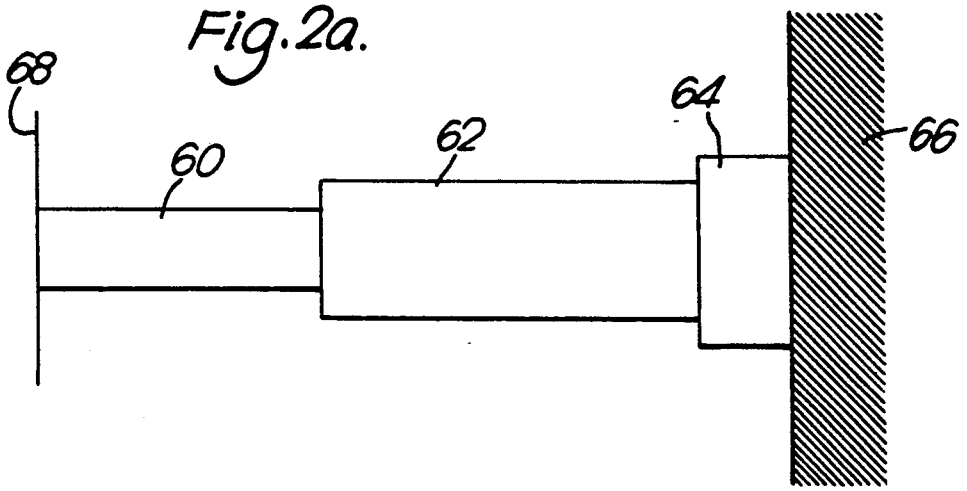
FIG. 2 is an illustration of the method of the invention, and more particularly on how the drillstring is modelled.
Figure 2B:
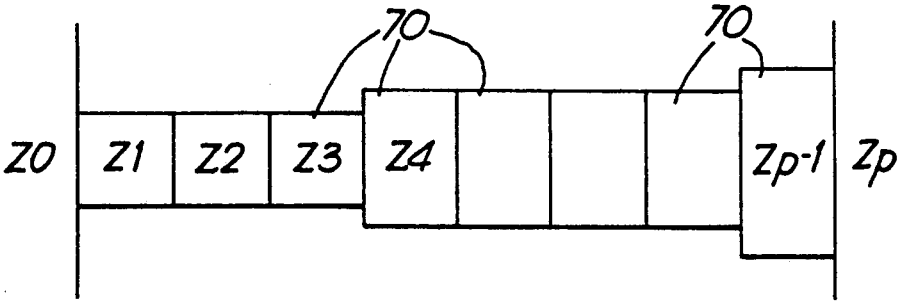

The physical model of the drillstring used in the analysis of the vibration data is illustrated on FIGS. 2*a* and 2*b*. A simple drillstring configuration is shown on FIG. 2*a*. The string is composed of drill pipes 60, drill collars 62 and drill bit 64 which drills through earth formation 66. The surface boundary, i.e. the drilling rig and more specially the rotary table is represented schematically by the line 68. The drillstring can be considered, for a single vibrational mode, i.e. torsional or axial, as a lossless and one dimensional transmission line with changes of impedance for each drillstring component. The string is modelled as an array of equal length components 70 with possibly different impedances $Z_0, Z_1, Z_2 \ldots Z_{p-1}, Z_p$ as shown in FIG. 2*b*. With sufficiently large number of sections this model can be made to approach arbitrarily close to an accurate geometrical representation of the drillstring.

Figure 2C:
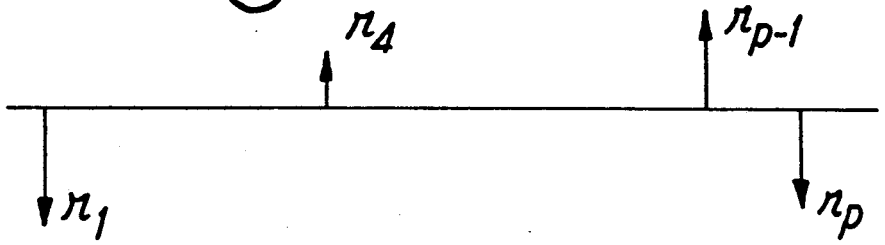

The vibrations generated by the working drill bit 64 propagate along the drill collar 62 and drill pipes 60 and are then reflected by the surface equipment 68. At each interface of different elements, i.e. interfaces drill bit/drill collars, drill collars/drill pipes and drill pipes/surface boundary there is a mis-match of impedance and therefore part of the vibrations are reflected at each interface. The reflection coefficients are represented on FIG. 2*c* by the arrows $r_1$, $r_4$, and $r_{p-1}$. They can be positive or negative depending on the difference (positive or negative) between the impedances Z of the two successive elements which are considered. In addition the formation 66 being drilled is treated as a terminating impedance $Z_p$ to the drillstring. The energy transmitted to the formation 66 does not return to the drillstring. An impedance mis-match between the drillstring and the formation results in a reflection of some of the energy back along the drillstring. This is represented by the reflection coefficient $r_p$ on FIG. 2*c*.

Transmission losses are relatively small in the drillstring since surface vibration data exhibit very large frequency peaks. The major source of energy loss in the system occurs at the interface bit 64/formation 66. In accordance with the preferred embodiment of the invention, the reflection coefficients of the system drillstring/bore hole are calculated by detecting and processing at the surface the vibrations generated by the rotating drill bit.

Figure 3:
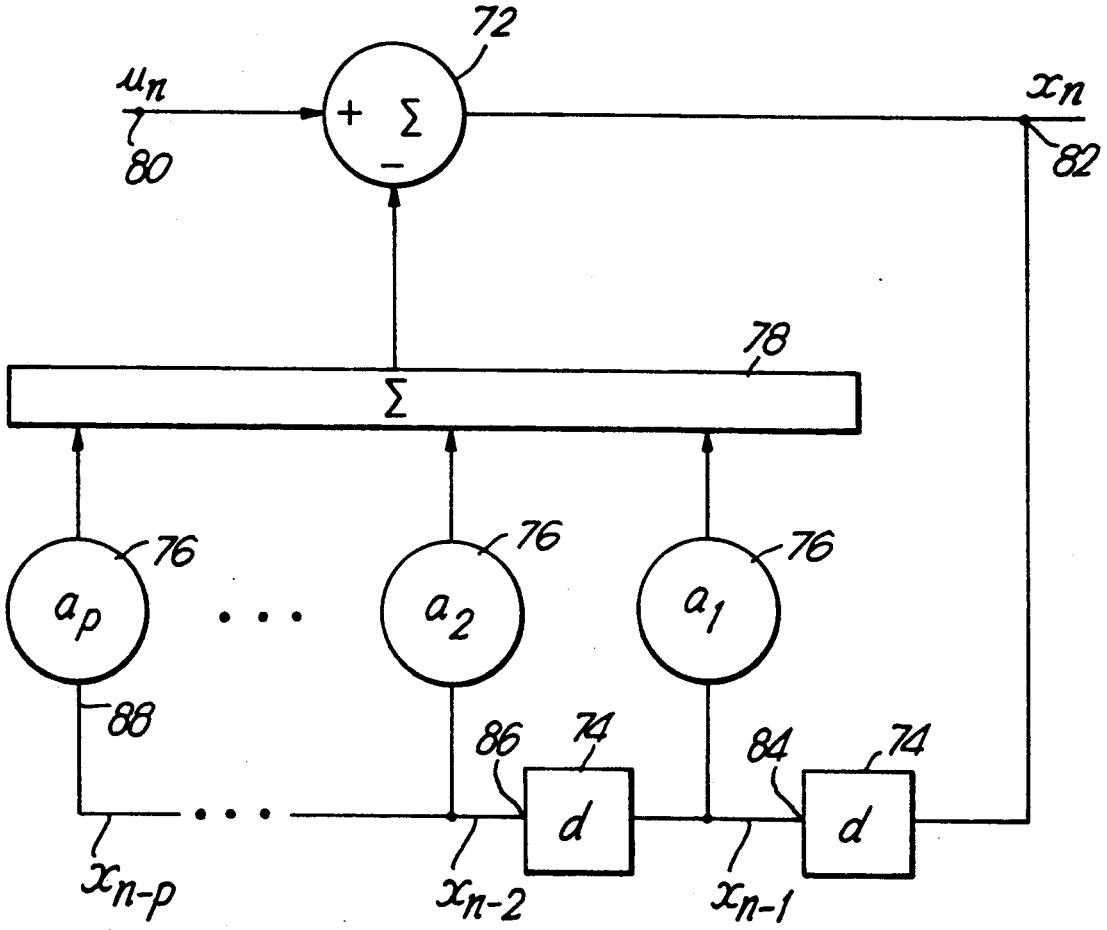
FIG. 3 is a schematic representation of an auto-regressive filter.

The vibration signal (amplitude versus time) detected at the surface can be modelled as the output signal $x_n$ at the filter output 82 of an auto-regressive filter represented in FIG. 3, driven by an input signal $u_n$ at the filter input 80 assumed to have a significant amplitude over a wide frequency band. The filter is composed of a summation circuit 72, delay lines 74 of equal delays d, weighting circuits 76 and finally summation circuit 78. The time delay d introduced by each delay circuit corresponds to the travel time of the vibrations to travel through an equal length element 70 (FIG. 2*b*). The signal $x_{n-1}$ at the output 84 of the first delay line 74 is the output signal generated by the filter at its output 82 prior to signal $x_n$. Similarly the signal $x_{n-2}$ at the output 86 of the second delay line 74 is the output signal delivered at 82 by the filter before it generated the signal $x_{n-1}$; and so on . . . The filter comprises p delay circuits 74 and p weighting circuits 76 and therefore the signal entering the last weighting circuit 76 (on the left of the figure) at its input 88 is $x_{n-p}$. The signals $x_{n-1}$ to $x_{n-p}$ are weighted, i.e. their amplitudes are changed, when passing through the weighting circuits 76 by a weighting factor $a_1$ to $a_p$. These factors $a_1$ to $a_p$ are called the filter coefficients, p being the order of the filter model. The weighted signals delivered by the weighting circuits 76 are added in the summation circuit 78 and then the sum of the weighted signals are substracted to the filter input signal $u_n$ in the circuit 72 so as to produce the filter output signal $x_n$. Expressed mathematically, the filter output signal $x_n$ is related to the p previous filter outputs $x_{n-1}$ to $x_{n-p}$ by the equation:

$$x_n = -\sum_{k=1}^{p} a_k x_{n-k} + u_n \tag{1}$$

The filter input signal $u_n$ represents the vibration signal generated by the drill bit. It is assumed to have white noise statistics, i.e. the noise input is actually uniformly spread across the frequency band of interest. The input signal to the drillstring is therefore regarded as a white band source of energy. The input signal $u_n$ can therefore be completely defined by the single number $rho_w$, which is the variance of the noise. However, as it will be mentioned later, the vibration signal generated by the bit could be not "white".

Let's assume that the vibration signal generated at the surface has been digitised at successive constant time intervals so as to obtain n samples representing the amplitudes of the signal versus time and let's assume that, among the n samples, a series of p successive samples is analysed (with $n >> p$). The signal composed of this series of p samples is compared with the filter output signal $x_n$. The filter coefficients $a_1$ to $a_p$ and $rho_w$ are estimated so that the two signals of the vibration samples and of the filter fit together.

Details of techniques to estimate the values of $a_k$ and $rho_w$ can be found in the literature, such as for example in the book "Digital Spectral Analysis with Applications" from S Lawrence Marple, Jr. published in 1987 by Prentice-Hall, Inc., Englewood Cliffs, N.J. Fast algorithms have been developed to minimise the computational complexity of estimating the parameters of the auto-regressive filter. Available algorithms divide into two broad categories, block data or sequential.

Block data algorithms are those in which the continuous data are split into continuous sections which are processed indefinitely. The Burg algorithm is probably the most widely known technique for estimating the auto-regressive parameters from a finite set of time samples. The Burg algorithm and its use are fully described in chapter 8 of the above mentioned book. Where a large number of time samples is available a technique known as the Yule-Walker method may be used, this uses the Fourier transform to estimate the auto-correlation sequence of the data, from which reflection coefficients and auto-regressive filter coefficients may be calculated using the well-known Levinson recursion.

Sequential algorithms may be applied to a continuous stream of time series data. These algorithms update estimates of the auto-regressive coefficients as single new data values become available. Two well known algorithms are the least-mean-square and recursive-least-squares methods. These two algorithms are described in chapter 9 of the above mentioned book.

When the values of the filter parameters $a_k$ have been determined, then the actual vibration data are not needed any more. As a fact from the parameters $a_k$ and the value of $rho_w$, the frequency spectrum H(w) (or more precisely the power spectral density) can be determined using the following equation:

$$H(w) = \frac{rho_w}{1 + \sum_{k=1}^{p} a_k e^{-jwk}} \tag{2}$$

Figure 4A:
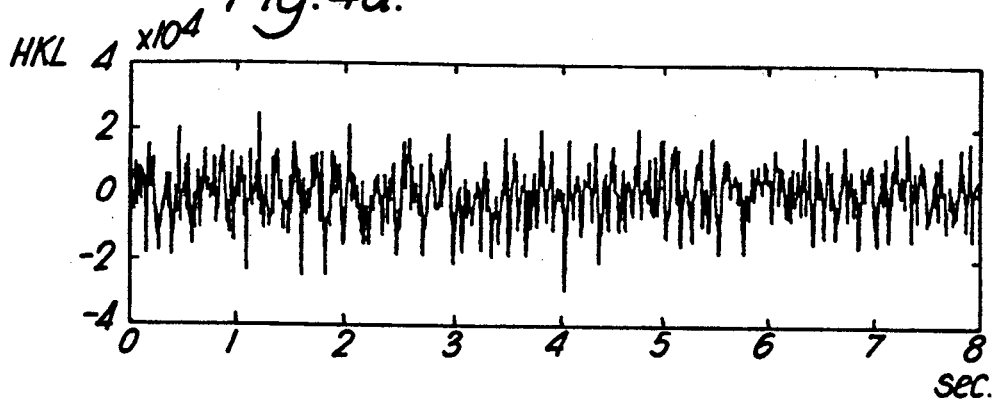
FIG. 4 shows vibrational data obtained at the surface and the comparison of the power spectra obtained by the prior art and by the invention.
Figure 4B:
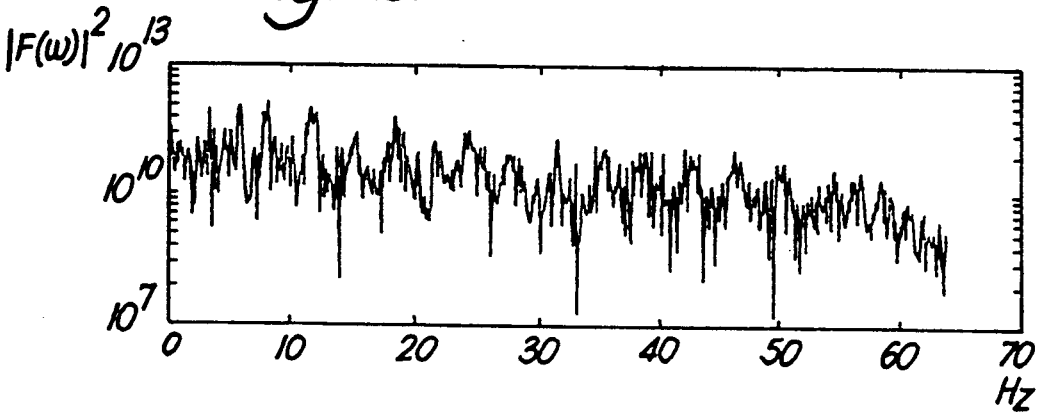
Figure 4C:
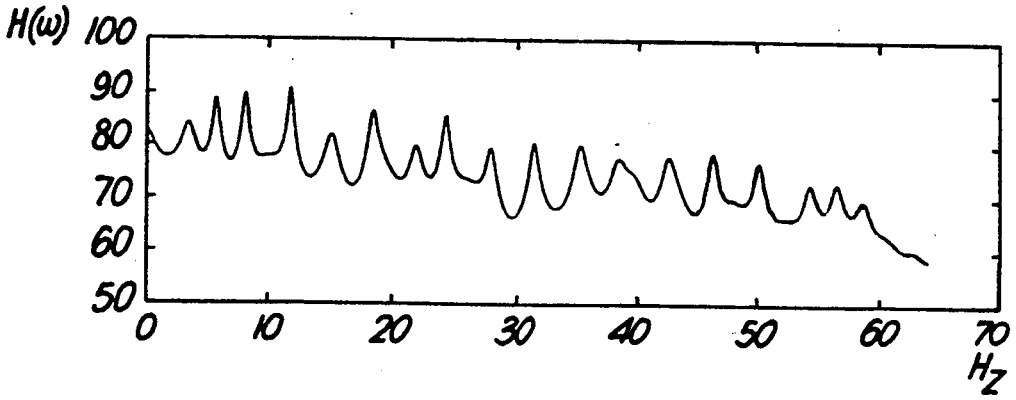

Although the determination of the spectrum is not necessary to implement the invention, it has been done nevertheless on FIG. 4 to compare spectra obtained by Fourier transform (FIG. 4*b*) and by an auto-regressive filter (FIG. 4*c*). FIG. 4*a* shows 8 seconds of raw hookload vibration data HKL recorded during a drilling segment. The mean value of hookload has been removed from the data. No significant features are visible in the raw data.

FIG. 4*b* shows the power spectral density $|F(w)|^2$ obtained by the Fourier transform F(w) of the time data. The signal contains significant energy over the whole of the frequency range shown, between 0 and 64 Hertz. The significant reduction in amplitude of the signal of over 50 Hertz is related to the roll-off of the anti-aliasing filter used in the digitisation process of the raw data. The quasi-random nature of the signal is reflected in the considerable variation in the spectral amplitude estimates from one frequency to another.

FIG. 4*c* shows the spectral estimate H(w) produced with the auto-regressive filter model shown on FIG. 2, with 64 delay circuits 74. The auto-regressive spectral estimate varies smoothly and contains features which can be compared to those barely visible in the Fourier transform spectral estimate of the FIG. 4*b*.

Once the filter coefficients $a_k$ are determined, the next step consists in determining the reflection coefficients $r_k$ from the values of the filter coefficients $a_k$.

This is achieved by a backwards recursion method in accordance to which the model order p is reduced by one at each successive iteration and the last filter coefficient computed at each iteration is equal to the reflection coefficient.

As an example, let's assume that $aP_k$ filter coefficients have been computed, with k varying from 1 to p, from an auto-regressive filter of order p. The series of filter coefficients is:

$$aP_1, aP_2, aP_3, \ldots aP_{p-2}, aP_{p-1}, aP_p.$$

The reflection coefficient $r_p$ is equal to $aP_p$.

Then the model order as reduced by one; so the order is equal to $(p-1)$. Each new filter coefficient $aP^{-1}j$ of this filter model of order $(p-1)$ is determined with the equation:

$$a_j^{p-1} = \frac{a_j^p - a_p^p a_{k-j}^p}{1 - (r_p)^2} \tag{3}$$

with j varying from 1 to $(k-1)$

The series of filter coefficients is therefore:

$$aP^{-1}1, aP^{-1}2, \ldots aP^{-1}p-3, aP^{-1}p-2, aP^{-1}p-1.$$

The reflection coefficient $r_{p-1}$ is equal to $aP^{-1}{}_{p-1}$.

The iteration is continued, decreasing the model order by one every time, so as to obtain the following series of filter coefficients:

$$ap^{-2}1, ap^{-2}2, \ldots ap^{-2}p-3, ap^{-2}p-2.$$

$a_{p-3}1, a_{p-3}2, \ldots a_{p-3}p-4, a_{p-3}p-3.$

... and so on, unitl $a^1{}_1$, the reflection coefficients being:

$$r_{p-2} = a^{p-2}_{p-2}$$
$$r_{p-3} = a^{p-3}_{p-3}$$
$$\vdots$$
$$r_1 = a_1{}^1$$

The method can be expressed mathematically by the two following equations:

$$r_k = a^k{}_k \tag{4}$$

$$a_j^{k-1} = \frac{a_j^k - a_k^k a_{k-j}^k}{1 - (r_k)^2} \tag{5}$$

for $1 \leqq j \leqq k-1$, where k goes from p down to 1 and $a^k j$ is the $j^{th}$ filter coefficient of the filter order k.

It should be noted that these reflection coefficients $r_k$ are in fact the filter coefficients of a lattice filter. As a consequence, instead of using the auto-regressive filter model of FIG. 2, it is possible to use directly a lattice filter model and to determine directly its filter coefficients which correspond directly to the reflection coefficients. However it is more convenient to use an auto-regressive filter model, to compute its filter coefficients $a_k$ and then to transform this filter coefficients into reflection coefficients $r_k$. The computation involved in transforming these autoregressive filter coefficients into reflection coefficients and the description of the lattice filter are also given in the above mentioned book "Digital Spectra Analysis with Applications".

As an example, the drilling vibration data of FIG. 4*a* are data obtained with the strain gauges on the pins 46 and 48 (FIG. 1) linking the hook 50 to the injection head 26. The drillstring which was used included a measurement while drilling (MWD) system, drill collars, heavy weight pipes and two different diameter drill pipes. The geometrical characteristics of this drillstring are given here below in Table 1:

TABLE 1

| Description | Internal Diameter (m) | Outside Diameter (m) | Length (m) |
|---|---|---|---|
| MWD | .0762 | .1651 | 17.2 |
| Collars | .0714 | .1778 | 61.3 |
| Heavy weight | .0762 | .1270 | 57.5 |
| drill pipe 1 | .0973 | .1143 | 30.5 |
| drill pipe 2 | .1016 | .1270 | 527.0 |

The Burg algorithm was used to compute the auto-regressive filter coefficients from the real surface vibration data displayed on FIG. 4*a*. The computed coefficients were then transformed to reflection coefficients as a function of depth along the drillstring, using equations 4 and 5. The computed reflection coefficients are shown on FIG. 5*a*, the abscissa representing the model order, i.e. the number of delay circuits 74 of the auto-regressive filter which is equal to the number of equal length elements 70 (64 in the given example).

Figure 5A:
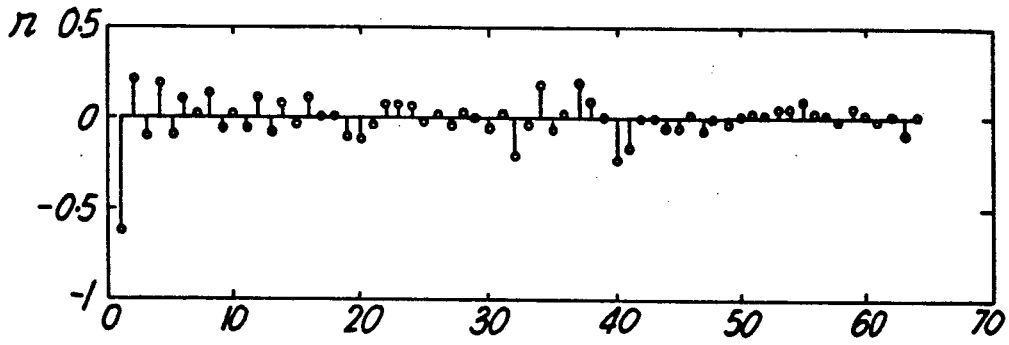
FIG. 5 shows the comparison of reflection coefficients obtained with the method of the invention and theoretically.

Knowing the velocity of the vibrations propagting in the drill pipe(about 5,000 meters per second), it is easy to determine the length of each equal length element of FIG. 2*a* by dividing the vibration propagation velocity by twice the frequency at which the vibration signal has been sampled. In the example of FIGS. 5*a* and *b*, the frequency was 128 Hertz and therefore the length between two elements was 19.53 meters. This length corresponds to the delay of each delay circuit 74 multiplied by the vibration velocity. Therefore, the numbers given in the abscissa of FIGS. 5*a* and *b* can be easily converted into depth by multiplying them by 19.53 m.

Figure 5B:
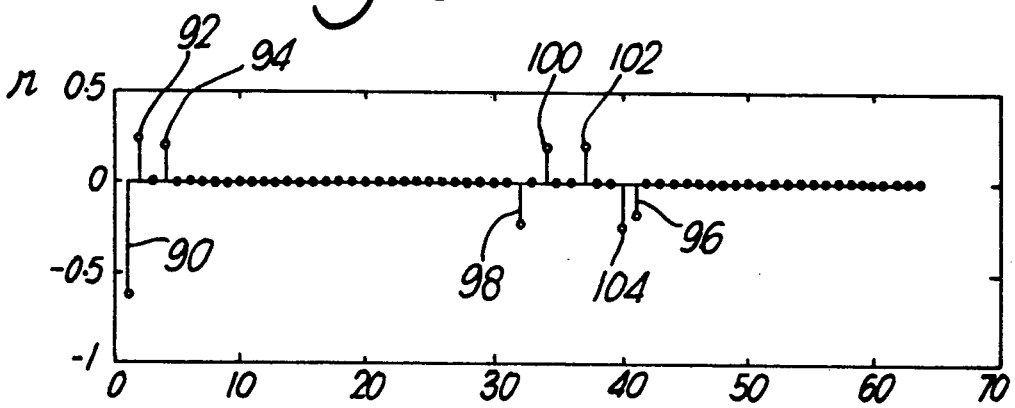
Figure 5C:
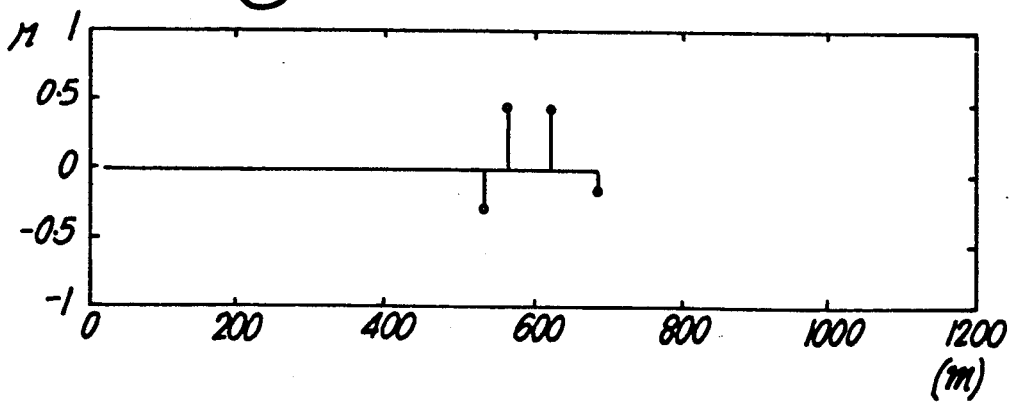

The significant reflection coefficients of FIG. 5*a* have been reproduced on FIG. 5*b* by keeping only the reflection coefficients greater than 15%. FIG. 5*c* shows the theoretical reflection coefficients as calculated from the simplified drillstring model given in Table 1. The theoretical reflection coefficients of FIG. 5*c* do not include the boundary conditions at the surface (which includes the effect of travelling block and cables) or at the bit. These reflection coefficients are apparent on FIG. 5*b* and have been indicated by the references 90, 92 and 94 for the surface boundaries and 96 for the interface drill bit/formation. The components of the drillstring which form the simplified model and can be seen FIG. 5*b* in the process data, include the interfaces between two pipes of drill pipe 98, some heavy weight drill pipe 100, the drill collars 102 and the MWD 104. This demonstrates that the invention is effective in detecting the dominant geometrical features of the drillstring. In addition, the processed data show features close to the surface which may be attributed to surface equipment such as the rotary table. A significant reflection is expected, and observed, at the surface termination of the drillstring. Also, at the other end of the drillstring constituted by the interface drill bit/formation, a reflection of the vibrations is detected (reflection coefficient 96).

The absolute amplitudes of the coefficients differ between FIGS. 5*b* and 5*c* due to the fact that the small details in the drillstring model have not been taken into account, such as cross-overs and tool joints which may nevertheless affect reflections between major drillstring elements. While it is straight-forward to include the effect of these smaller items in determining the reflection coefficients from the model, they give rise to features which are below the limits of resolution when processing data of this band width.

The number of delay circuits 74 (FIG. 3) used in the model or the number of equal length elements 70 (FIG. 2*b*), depends on the amount of detail wanted to be seen as a function of depth, on the band width of the data and on the length of the drill string. At a minimum, the number of elements should be sufficient to cover at least the actual length of the drillstring. If more elements are used, then the reflection coefficients computed for the elements after the drill bit (starting from the surface) should be zero or at least negligible. This can be seen in FIG. 5*a* for the reflection coefficients after the element number 41 or after the reflection coefficient 96 on FIG. 5*b*. As already indicated, there is a direct relationship between the time delay d introduced by each delay circuit of the filter model and the length of the equal length element (70 on FIG. 2*a*) knowing the sample rate of the original vibration data and the speed of the vibration propagation along the drillstring.

As is well known, the reflection of the vibration wave in the drillstring is due to a mis-match of impedance of two consecutive elements of the drillstring, or more generally of the system drillstring/bore hole. If one considers two consecutive elements of impedance $Z_{k+1}$ and $Z_k$, the reflection coefficient $r_k$ at the interface is given by:

$$r_k = \frac{Z_{k+1} - Z_k}{Z_{k+1} + Z_k} \quad (6)$$

The terminating reflection coefficient, which corresponds to the interface between the drill bit and the formation being drilled, represents the impedance contrast between the drillstring and the formation. This reflection coefficient contains information on the mechanical characteristic of the formation being drilled, and more especially about its hardness. It should be noticed that in the already mentioned U.S. Pat. No. 3,520,375, the computation of this reflection coefficient is based on the energy contained in a specific frequency band, which is not the case with the present invention.

Any significant reflections which occur at depth in the drillstring which are not related to the geometrical construction of the drillstring may be ascribed to interaction between the drillstring and the bore hole wall. Thus potential sticking pipe problems could be indicated by the computation of high reflection coefficients at depths where the string make-up suggests none should occur.

Knowing the reflection coefficients of the drillstring and the amplitude $rho_w$ of the input signal $u_n$ of the auto-regressive filter, the downhole vibration levels at all points in the drillstring can be calculated easily. Of particular interest is the estimate of the input excitation power since this offers the opportunity to detect damaging downhole vibration levels from the surface.

Instead of having white noise statistics for the input signal $u_n$ of the filter, the true vibration signal generated by the drill bit could be used instead. For example, in cases where the vibration signal generated by the bit is not "white", $u_n$ may be modelled by the output of another filtering process, for example $$u_n = \sum_{k=o}^{q} b_k u_{n-k} \quad (7)$$

In this case, the bit vibration is modelled as a so-called "moving average" process. The parameters $b_k$ may be estimated by a number of well-known techniques and then used to "pre-whiten" the signal $x_n$ before the remaining processing.

One of the applications of the computation of the filter coefficient is to estimate the vibration generated by the drill bit. As a fact, it can be assumed that the reflection coefficients, once determined, will not change substantially over a limited period of time, say 5 or 10 minutes depending on the drilling conditions, such as the rate of penetration. Knowing the reflection coefficients, the input signal $u_n$ which represents the drill bit vibration can be determined. The derived filter coefficients are therefore used to remove drillstring resonances from the surface vibrations and thereby determine the vibration generated by the rotating drillbit.

The invention has been described with reference to roller-cone drill bit. Other types of drill bit can be used, such as polycrystalline diamond compact (PDC) bits, as long as the bits generate vibrations downhole which are transmitted in the drill string.

I claim:

1. Method of monitoring the drilling of a borehole through an earth formation with a rotating drill bit fixed at the lower end of a drillstring comprising the following steps:

detecting with at least one transducer at least one physical quantity associated with the vibrations resulting from the interaction of the rotating drill bit with the earth formation;

generating an oscillatory signal in response thereto;

determining filter coefficients $a_k$ of a filter model having an input signal Un and an output signal Xn by fitting the filter output signal Xn with the oscillatory signal;

from said filter coefficients, deriving reflection coefficients of the vibrations propagating along the drill string and being reflected by a mis-match of impedance of two successive elements of the system earth formation/drillstring; and determining from said reflection coefficients at least one physical characteristic related to the drilling of the borehole.

2. Method according to claim 1, wherein said filter model is an auto-regressive filter.

3. Method according to claim 2, wherein said auto-regressive filter is driven by an input noise signal comprising a substantially white noise signal whose frequency band is estimated from the oscillatory signal.

4. Method according to claim 2, wherein the filter coefficients of the auto-regressive filter are converted into the coefficients of a lattice filter which represent said reflection coefficients.

5. Method according to claim 1, wherein the reflection coefficient at the interface between the drill bit and the formation being drilled is determined, said reflection coefficient characterising the mechanical property of the formation.

6. Method according to claim 1, wherein the reflection coefficients occurring at depths not related to the geometry of the drillstring are determined, these reflection coefficients characterising interactions between the borehole wall and the drillstring.

7. Method according to claim 1, further comprising the steps of determining the amplitude of the filter input signal and deriving the vibration level occurring in the drillstring at particular points in the drillstring from said amplitude and said reflection coefficients.

8. Method according to claim 1, wherein the derived filter coefficients may be used to remove drillstring resonances from vibrations and thereby determine the vibrations generated by the rotating drillbit.

* * * * *